US007942786B2

(12) United States Patent
Rolli

(10) Patent No.: US 7,942,786 B2
(45) Date of Patent: May 17, 2011

(54) TRAINING DEVICE FOR TARGETED TRAINING

(76) Inventor: Engelbert Rolli, Stuttgart (DE)

( * ) Notice: Subject to any disclaimer, the term of this patent is extended or adjusted under 35 U.S.C. 154(b) by 0 days.

(21) Appl. No.: 12/726,698

(22) Filed: Mar. 18, 2010

(65) Prior Publication Data

US 2010/0173752 A1 Jul. 8, 2010

Related U.S. Application Data

(62) Division of application No. 10/510,815, filed as application No. PCT/DE03/01123 on Apr. 4, 2003, now Pat. No. 7,691,033.

(30) Foreign Application Priority Data

Apr. 9, 2002 (DE) ..... 102 15 622
Jan. 3, 2003 (DE) ..... 103 00 253

(51) Int. Cl.
*A63B 22/00* (2006.01)
*A63B 22/06* (2006.01)

(52) U.S. Cl. ..... 482/51; 482/57; 482/142

(58) Field of Classification Search ..... 482/51, 482/52, 53, 57, 62, 70, 71, 54, 58, 59, 60, 482/61, 79, 80, 146, 147, 142, 908; D21/665, D21/666; 601/36; 472/88, 89, 90, 91; 434/61, 434/67, 255, 256; D6/382; 5/101; 280/224–227, 280/230–233
See application file for complete search history.

(56) References Cited

U.S. PATENT DOCUMENTS 554,754 A 2/1896 Webber
3,057,201 A 10/1962 Jaeger
3,213,852 A 10/1965 Zent
3,307,534 A * 3/1967 Gibbs ..... 601/26
3,572,699 A 3/1971 Nies
3,905,597 A 9/1975 Tabb
3,964,742 A 6/1976 Carnielli
4,402,502 A 9/1983 Peters
4,417,745 A 11/1983 Shomo
4,436,097 A 3/1984 Cunningham
D279,918 S 7/1985 Stumbaugh et al.
4,579,360 A 4/1986 Nishimura et al.
4,580,983 A 4/1986 Cassini et al.
4,705,269 A 11/1987 DeBoer et al.
4,743,010 A 5/1988 Geraci
4,846,156 A 7/1989 Kopnicky
(Continued)

FOREIGN PATENT DOCUMENTS

DE G 8623738.1 U1 4/1987
(Continued)

*Primary Examiner* — Loan Thanh
*Assistant Examiner* — Daniel F Roland
(74) *Attorney, Agent, or Firm* — Venable LLP; Robert Kinberg

(57) ABSTRACT

A training device to target train a body of a person includes a support, a device foot part having action elements for legs of the person, a device arm part having action elements for arms of the training person, and a connecting joint, mounted on the support, to couple the device foot part with the device arm part. The connecting joint allows the device foot part and the device arm part to displace relative to each other about a common longitudinal axis that runs through the connecting joint, device arm part and device foot part which causes a relative turning movement in a region of a vertebral column axis of the person, when lying on the device, between the pelvic girdle and the shoulder girdle of the person.

5 Claims, 7 Drawing Sheets

U.S. PATENT DOCUMENTS

| | | | | | |
|---|---|---|---|---|---|
| 4,925,183 | A | | 5/1990 | Kim | |
| 4,958,832 | A | | 9/1990 | Kim | |
| 5,035,418 | A | | 7/1991 | Harabayashi | |
| 5,044,627 | A | | 9/1991 | Huang | |
| 5,141,483 | A | * | 8/1992 | Smith | 482/142 |
| 5,232,422 | A | | 8/1993 | Bishop, Jr. | |
| 5,330,402 | A | | 7/1994 | Johnson | |
| 5,336,147 | A | | 8/1994 | Sweeney, III | |
| 5,338,272 | A | | 8/1994 | Sweeney, III | |
| 5,419,573 | A | | 5/1995 | Kao | |
| 5,545,111 | A | | 8/1996 | Wang et al. | |
| 5,569,128 | A | | 10/1996 | Dalebout | |
| 5,645,512 | A | | 7/1997 | Yu | |
| 5,749,809 | A | | 5/1998 | Lin | |
| 5,800,313 | A | | 9/1998 | Yu | |
| 5,842,710 | A | * | 12/1998 | Couture | 280/204 |
| 5,860,899 | A | * | 1/1999 | Rassman | 482/142 |
| 5,908,373 | A | | 6/1999 | Pitre | |
| 5,931,765 | A | | 8/1999 | Huang | |
| 5,947,873 | A | | 9/1999 | Sands et al. | |
| 5,980,431 | A | | 11/1999 | Miller, Jr. | |
| 6,036,623 | A | | 3/2000 | Mitchell | |
| 6,066,076 | A | | 5/2000 | Wang et al. | |
| 6,132,341 | A | | 10/2000 | Lin | |
| 6,149,552 | A | | 11/2000 | Chen | |
| 6,220,991 | B1 | | 4/2001 | Sellers | |
| 6,309,326 | B1 | | 10/2001 | Huang | |
| 6,561,952 | B2 | | 5/2003 | Wu | |
| 6,648,802 | B2 | | 11/2003 | Ware | |
| 6,712,737 | B1 | | 3/2004 | Nusbaum | |
| 6,733,429 | B2 | * | 5/2004 | Nizamuddin | 482/142 |
| 6,857,992 | B1 | | 2/2005 | Kolda et al. | |
| 6,918,861 | B2 | | 7/2005 | Liao et al. | |
| 7,090,628 | B2 | * | 8/2006 | Badarneh | 482/140 |
| 7,147,589 | B2 | | 12/2006 | Chae | |
| 7,608,025 | B1 | * | 10/2009 | Best | 482/123 |
| 7,704,200 | B2 | * | 4/2010 | Rahimi | 482/142 |
| 2002/0004439 | A1 | | 1/2002 | Galbraith et al. | |
| 2003/0092533 | A1 | * | 5/2003 | Hippensteel | 482/56 |
| 2003/0186794 | A1 | * | 10/2003 | Vittone | 482/142 |
| 2003/0195094 | A1 | * | 10/2003 | Kim | 482/142 |
| 2004/0023759 | A1 | | 2/2004 | Duncan et al. | |
| 2004/0077465 | A1 | | 4/2004 | Schmidt | |
| 2005/0101460 | A1 | * | 5/2005 | Lobban | 482/140 |

FOREIGN PATENT DOCUMENTS

| | | | |
|---|---|---|---|
| DE | 43 21 558 | A1 | 5/1994 |
| DE | 298 16 928 | U1 | 2/1999 |
| DE | 299 13 080 | U1 | 10/1999 |
| DE | 198 28 025 | A1 | 1/2000 |
| DE | 200 01 315 | U1 | 6/2000 |
| DE | 202 00 580 | U1 | 6/2002 |
| DE | 101 31 377 | A1 | 1/2003 |
| GB | 2 349 099 | A | 10/2000 |

* cited by examiner

TRAINING DEVICE FOR TARGETED TRAINING

CROSS-REFERENCE TO RELATED APPLICATION

This application claims priority to German Patent Application No. 10215622.0 filed Apr. 9, 2002 and German Patent Application No. 10300253.7 filed Jan. 3, 2003 and is a divisional application of U.S. application Ser. No. 10/510,815 which was a national phase application under 35 U.S.C. §371 of PCT/DE2003/01123 filed Apr. 4, 2003, all of which are incorporated herein by reference in their entirety.

BACKGROUND

The invention relates to a method and device for conducting a targeted training of the human body.

Methods and training devices of this type are used for developing and strengthening the muscles or joints of the body by overcoming resistances as well as for increasing fitness and stamina. The disadvantage of known methods and training devices is these always involve only individual parts of the body and not the complete body, so that a plurality of different devices are offered to achieve a total-body training. With many devices, the upper body, arms and neck remain in the same position during the training while the legs and lower body are active.

With other devices, in turn, the upper body is active and the lower body and legs are passive. Not least, the known methods and training devices do not involve mental training.

With a known training device of the generic type (DE OS 37 42 513), a handlebar lever can be activated by swiveling it back and forth using the legs and a pedal crank system with chain. In contrast to the bicycle operation, it allows the shoulder girdle to move back and forth which could result in a relative twisting of the vertebral column in the region between shoulder girdle and pelvic girdle. Apart from the fact that this involves only a slight twisting—with lazy trainers perhaps only a movement of the arms without twisting of the shoulder girdle—it also involves only a partial training of the body and this without parallel mental training since any mental activity or coordination of the movements is unnecessary due to the simple forced control.

To be sure, with a different known training device of the generic type (EP OS 0354785) a certain mental training may be possible as a result of the simulated bicycle ride around curves. However, this is done at the expense of the scope of physical training, so that additional devices must be used for a comprehensive training.

SUMMARY

In contrast, the method according to the invention with the characterizing features as described below, as well as the training device offers the advantage of a total-body training using a single method and device, meaning a total-body training with proprioceptive orientation specifically for the torso area between shoulder and pelvic girdle, wherein the natural movement dynamic of a person is simulated. The resulting alternating but harmonic activity of the brain halves for controlling these movements leads to intensive mental training. If hands, arms and shoulders are turned in one direction, then hip, pelvic girdle and legs are turned in the opposite direction. The resulting simultaneous turning of the different body regions in opposite directions is made possible through the twisting and a simultaneous slanted movement to the side of the vertebral column. This simultaneous counter movement (counter rotation) of different body regions corresponds to a high degree to the proprioception of humans (the neuronal control of the muscle/skeleton apparatus).

The method and the training device are therefore optimally suited to a proprioceptive training and a body-dynamic training of muscle chains, in particular a back training. The movements, supported by the training device, stimulate and make possible the mental activity of the person, thus leading to the aforementioned mental training. The training device therefore can be used not only for healthy persons, but also for sick persons. The training method has a positive effect particularly in cases of damage to the vertebral disks. The method and device can also be used in the same way for children.

According to one embodiment of the invention, there is provided a training device to target train a body of a person lying on the training device, the device comprising: a support to secure the training device locally; a device foot part adapted to support a lower portion of the person's body and having action elements for legs of the person; a device arm part adapted to support an upper portion of the person's body and having action elements for arms of the training person; and a connecting joint, mounted on the support, to couple the device foot part with the device arm part via the connecting joint to allow the device foot part and the device arm part to displace relative to each other about a common longitudinal axis that runs through the connecting joint, device arm part and device foot part, to cause a relative turning movement in a region of a vertebral column axis of the person, when lying on the device, between the pelvic girdle and the shoulder girdle of the person.

According to another embodiment of the invention, there is provided a training device to target train a body of a person lying on the training device, the device comprising: a support to secure the training device locally; a training bench having a rotational axis that extends in a longitudinal direction of the training bench, the training bench having a dividing area that laterally divides the training bench into first and second longitudinal sections, wherein: the first longitudinal section comprises a device foot part with action elements for legs of the person, and the second longitudinal section comprises a device arm part with action elements for arms of the person, the action elements including cranks, levers, or other operating devices, wherein the device foot part and the device arm part are displaceable relative to each other about the rotational axis to cause the person, when lying on the device, to execute training movements; and a connecting joint coupled to the support and the training bench at the dividing area to mount the training bench.

According to one advantageous embodiment of the invention involving the method, a side-slanted or curved movement of the vertebral column is superimposed on the relative twisting movement with respect to the longitudinal axis, wherein this slanted movement to the side can also be achieved with some training devices according to the invention. In any case, the invention results in a constantly changing physical load due to the given super-imposition of relative twisting movement and slanted movement to the side, which also helps strengthen the actively used muscle bands.

According to another advantageous embodiment of the inventive method, the activity of arms or legs determines the relative twisting between shoulder girdle and pelvic girdle and/or the slanted movement of the vertebral column, within the meaning of compensating a natural, dynamic turning moment. The compensation of a natural, dynamic turning moment of this type corresponds to the human movement principle, for example when walking or running, causing the left shoulder and the right hip to be twisted backward if weight is put on the left foot and the right shoulder and left hip to be correspondingly twisted forward, wherein the opposite occurs when weight is put on the right foot.

According to a different, advantageous embodiment of the method, the work supplied by the activity of the limbs is input and used as energy source. This can be done in different ways, but in particular through converting it to electrical energy, e.g. by means of an eddy current brake. The electrical energy can be stored in a manner known per se and can be used at a later time. The work can then be displayed on a display panel for the person training, in particular in connection with other core variables such as the time, which is known from numerous applications.

A different, advantageous embodiment provides for the method to be realized under water, wherein at least the pelvic girdle should be submerged and a soft braking effect is achieved through the movement in water. Special advantages can be achieved with a precisely controlled water temperature, the influence of the surrounding water pressure on the training, as well as the buoyancy and composition of the water.

According to an additional embodiment of the inventive method, oxygen-enriched air is provided for breathing in during the training and the associated physical movements, wherein the oxygen content is preferably adjustable. Thus, the amount of oxygen in the available oxygen-air mixture can be controlled depending on the measured physical performance of the training person, for example by increasing the amount of oxygen with increasing physical performance and decreasing it with decreasing physical performance. As is known, the body can absorb increased amounts of oxygen during increased performance, thus causing the arterial oxygen pressure to increase. The oxygen volume share at peak performance can amount to up to 75% of the oxygen-air mixture breathed in. As discovered by the scientist von Ardenne[1], the quality of the oxygen absorbed into the bloodstream is directly proportional to the performance of the person, which can also lead to a longer-term increase in the partial pressure of oxygen in the blood.

[1] Note: Refers to Manfred von Ardenne, German physicist 1907-1997

According to one such advantageous embodiment of the invention, the environmental air enriched with oxygen is ionized, thus resulting in a better oxygen absorption by the human body.

According to one advantageous embodiment of the training device, the alternating relative twisting movement in at least one turning direction can be effected randomly by the training person. As a result of this active, purposely initiated activity, the training also has a mental aspect taking the form of strengthening the mental area of the training person.

According to a different embodiment of the training device according to the invention, the alternating relative twisting movement in at least one turning direction is externally controlled and/or operated, wherein this external control or drive is advantageous in certain training situations, e.g. for optimizing the control and movement sequences. For example, the relative twisting movement can be a random movement in one turning direction and can be controlled in the other turning direction. As a result, specific areas of the body can be strengthened mentally while only a physical strengthening can be achieved in other areas.

According to yet another advantageous embodiment of the training device according to the invention, a lower-positioned seat with or without back support is provided on the foot part of the device. This embodiment is also intended primarily for training individuals for whom it makes sense to have such a lower-positioned seat, at least at times during the training. Depending on the training person, the seat on the training device can generally also be adjusted upward.

A different embodiment of the inventive training device is provided with an action element having hand-operated cranks on the device arm part, in particular designed as alternative or even to complement a rigid handlebar or swiveling levers. With devices having an eddy current brake, this brake can be used for the arm training.

With another advantageous embodiment of the inventive training device, additional transmitters, computers, and display units (displays) are provided for the pulse rate, blood pressure, training length and the like, wherein these instruments primarily belong to the accessory range, but support the special advantages of the method and training device according to the invention. The computer can be used for processing a large variety of software, particularly special motivational programs or other evaluation programs—especially the evaluation and update via the Internet. Thus, chip cards relating to persons and the like can also be used.

One special, advantageous embodiment of the inventive training device consists of a frame mounted on the support, wherein the frame is provided with a seat and a handlebar as well as a drive unit with pedals and consists of two frame halves. The front frame half in this case functions as device arm part which carries the handlebar while a back frame half functions as device foot part that contains the seat and drive unit, wherein the two frame halves are furthermore connected via a connecting joint with nearly vertically extending joint axis and wherein the front end of the front frame half and/or the back end of the rear frame half are positioned such that they can be deflected on pivot bearings to the side and/or toward the front/back and wherein the connecting joint is positioned approximately in the center between the pivot bearings for the front frame half and the rear frame half. To be sure, an ergometer stand is known for holding a bicycle frame with frame halves consisting of supports and columns and elastic positioning of the front wheel fork, wherein the support for the frame half that holds the rear-wheel fork is positioned transverse to the bicycle frame, so as to be flexible and able to swivel, in its base (DE PS 196 46 799). However, this is a training device where the pelvic girdle can only be displaced laterally, corresponding to the frame configuration, and cannot be turned relative to the shoulder girdle.

The front and rear frame halves of this inventive embodiment must be positioned displaceable since a deflection to the side of the rotating joint is tied to a position change of the front and rear frame half (buckling principle). For this, pivot bearings that can be displaced to the side as well as toward the front or back are provided, particularly on the front end of the front frame half and the back end of the rear frame half. The joint is positioned approximately in the center between the pivot bearings for the front frame half and the rear frame half, wherein the center position does not have to be maintained precisely. The joint position can deviate from the precise center position by up to approximately 5% with respect to the total distance between the front and rear pivot bearing. However, greater deviations do not make sense because they no longer meet the requirements for the buckling principle typical in that case. The joint axis extends nearly vertical, but slight variations are possible as well. Thus, the joint axis can also be slanted by a specific angle relative to the vertical line.

According to one advantageous embodiment, the pivot bearing for the front frame half can be rotated around a vertical axis, but is otherwise locally fixed. A deflection to the side occurs only at the joint between the front and rear frame halves and at the pivot bearing for the rear frame half, which corresponds to a first embodiment of the training device. The mode of operation can be called active training or active mobilization training since the training person normally must actively cause a deflection of the joint between the two frame halves by turning the pelvic area and using the back muscles, the abdominal muscles, and the arm muscles.

With a second variant of this embodiment of the training device, the pivot bearings for the front and the rear frame halves either directly or indirectly cooperate with a slide that can be displaced to the side and/or in longitudinal direction. If the user pushes one of the pedals downward, the joint between the front and rear frame half is deflected to the side. If the user pushes the other pedal downward, the joint is deflected in the opposite direction. Since the joint deflection is caused by depressing the pedals and does not have to be caused actively by the user, this mode of operation can be called reactive, reactive stabilization training. This active or reactive type of training can be realized with all following training devices by using corresponding technical designs.

Depending on the type of embodiment, only the pivot bearing for the rear frame half or the pivot bearings for the front and rear frame halves are connected directly or indirectly with a slide that can be displaced to the side and/or in longitudinal direction. Since a deflection of the connecting joint between the two frame halves leads to a shortening of the distance between the front and rear frame half, a displacement in longitudinal direction of at least one of the two pivot bearings is necessary. Special training effects can be achieved with the deflection to the side of the rear frame half. In the process, the front and/or rear frame half can rest on the shaft of a rotating wheel or a roller. Wheel and roller in that case are positioned inside the displaceable slide and roll off this slide. The wheel or roller of the rear frame half in that case is connected to the drive unit and is set to rotate by the drive unit. Limit stops for guiding the wheel can be provided on the sides of the slide.

The deflection to the side of the front and/or rear axis of rotation can be realized on all suitable training devices according to the invention, for example through a double-jointed positioning.

With the first embodiment using the active mode of operation, for which the pivot bearing for the front frame half can rotate around a vertical axis, it is possible to provide only the rear frame half, for example, with a wheel guided on a slide.

According to a different advantageous embodiment of the inventive training device, a slide is provided for guiding the connecting joint between the front and rear frame halves, wherein this type of guidance aides the deflection of the joint. In the process, the slide moves along a path with parabolic course. This type of guidance permits a deflection to the side as well as a displacement in height. With a correspondingly stable guidance, the front as well as the rear frame halves can be provided with a wheel. If both wheels are guided in side-displaceable slides, they can be connected to realize the buckling principle.

According to an additional, advantageous embodiment of this training device, the device foot part is provided with a drive unit, consisting of bottom bracket bearing, crank mechanism, pedals and a drive assembly that is connected to the wheel or the roller on the rear frame half, wherein a chain, a cardan drive, a toothed belt or the like functions as drive assembly. Furthermore, a bottom bracket bearing which permits only the up and down movement of the pedals can be used in place of the bottom bracket bearing with rotating axis.

The force acting upon the wheel or roller can be adjusted manually, so that the user can vary the dynamic output he/she must generate during the pedaling operation, wherein additional performance measuring devices such as a pulse counter can be provided as well. The force acting upon the wheel or roller is adjusted automatically with a corresponding control and in dependence on the dynamic output determined for the training person. The drive unit can optionally be provided with or without a free-running hub.

The displaceable slide on which the wheel rolls off can be provided with one or several rollers, so as to simulate a wheel rolling off a solid base. Side-mounted limit stops with adjustable spacing prevent the wheel from sliding off the rollers, wherein rollers or wheels can again be used for these limit stops. The rollers of the slide on which the wheel rolls off can actively drive the wheel with the aid of a drive that can be added.

According to a different advantageous embodiment of this device according to the invention, the handlebar and the saddle are arranged on the frame, such that they can be adjusted in height and distance relative to each other. The training device can thus be adapted to different users.

With a different specialized and advantageous embodiment of the training device, comprises a running device in the device foot part that extends mostly in horizontal direction, e.g. similar to the so-called elliptical trainer, and mostly vertically extending arm rods in the device arm part, the axis of rotation of the hinge-type connecting joint extends primarily in vertical direction while the device foot part and/or the device arm part can be displaced along the support in the direction predetermined by the running direction of the training device. If necessary, the connecting joint can also be secured in place locally, so that the buckling movement between device foot part and device arm part, which occurs in this case as well, results in a corresponding displacement of the ends of the device foot part and the device arm part, in particular along a circular course. It is critical that a corresponding relative twisting movement occurs in the vertebral column axis between shoulder girdle and pelvic girdle during the twisting of device arm part relative to device foot part.

The running device for an advantageous embodiment of the invention of this type is provided with a moving belt, wherein such a moving belt can be driven, if necessary, but can also be moved as a result of the running/walking movement of the training person. Even though multiple designs for running belts are known per se, it is nevertheless true for the use according to our invention that the "knee joint" must exist between device arm part and device foot part to achieve the relative twisting movement between shoulder girdle and pelvic girdle.

The running device of one such advantageous alternative embodiment of the invention is provided with tread plates or a pedal system. In the known manner, the device foot part contains a flywheel mass along with these tread plates or the pedal system. According to a different embodiment of the invention, this flywheel mass can be connected in the manner of a crank mechanism with the tread plates and/or the pedal system. It is important that with a system of this type, which is already known from a plurality of designs, the device arm part forces the shoulder girdle to occupy a different turning position than the pelvic girdle, owing to the relative twisting motion. In place of the known coupling of flywheel mass, crank mechanism via the tread plates on the arm rods, a synchronizing of this type can also be achieved via cable pulls or the like.

According to a related advantageous embodiment of the invention, the arm rods can be swiveled synchronous with the running/walking movement.

The swiveling resistance of the arm rods can be adjusted with a different, advantageous embodiment of the invention of this type, thus making it possible above all to achieve a build-up of muscles during the training.

The device foot part and the device arm part of a different, special and also advantageous embodiment of the inventive training device are respectively provided with one section of a laterally divided training bench, wherein a longitudinally extending axis of rotation functions as connecting joint between the sections in the dividing area and wherein cranks, levers and other operating devices are arranged on the respective training bench section as action elements. A training device of this type is used primarily for specialized training measures.

One such embodiment of the invention provides that the ends of this training bench can be turned by 180°, if positioned on corresponding bearings, thus making it possible in one position to train while resting on the abdomen and in the other position while resting on the back.

According to a different advantageous embodiment of the invention of this type, the training bench can be positioned at a slant with respect to its longitudinal extension, which can be advantageous, particularly for special training tasks.

Yet another, special and advantageous embodiment of the training device according to the invention calls for the device foot part and the device arm part to be arranged on a vertical, but laterally divided support column, wherein an also vertically extending axis of rotation is arranged as connecting joint between the parts and wherein vertically activated but horizontally projecting tread or hinged plates are provided on the device foot part. A training device of this type, also called a climber, makes it possible to realize conditioning training methods and to achieve a relative twisting movement between shoulder girdle and pelvic girdle, which closely approximates the realistic conditions for a mountain climber.

Vertically activated hand grips are provided on the device arm part of a different, advantageous embodiment of the invention, for which the displacement movement is synchronized with the movement of the tread plates or hinged plates. The synchronized movement above all is designed to correspond to the normal human movement rhythm, meaning the left arm approaches the right foot and conversely the right arm approaches the left foot. This movement typically can be observed during walking, thus resulting among other things in a natural compensation of the turning moment during the dynamic movement.

Additional advantages and advantageous embodiments of the invention follow from the longitudinal section described in the following, the drawing, as well as the claims.

BRIEF DESCRIPTION OF THE DRAWINGS

The subject matter of the application will be more readily understood from the following detailed description when read in conjunction with the accompanying drawings, in which.

DETAILED DESCRIPTION

Figure 1:
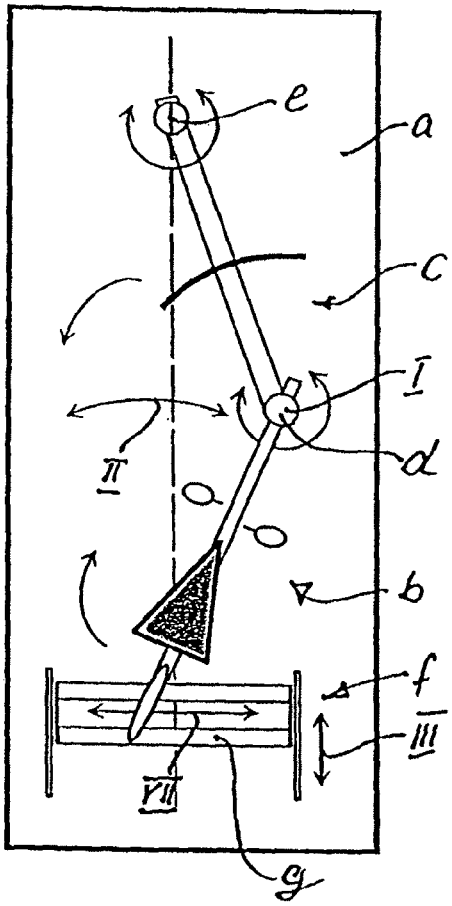
FIGS. 1 to 3 are functional principles of embodiments of the invention in a view from above.
Figure 2:
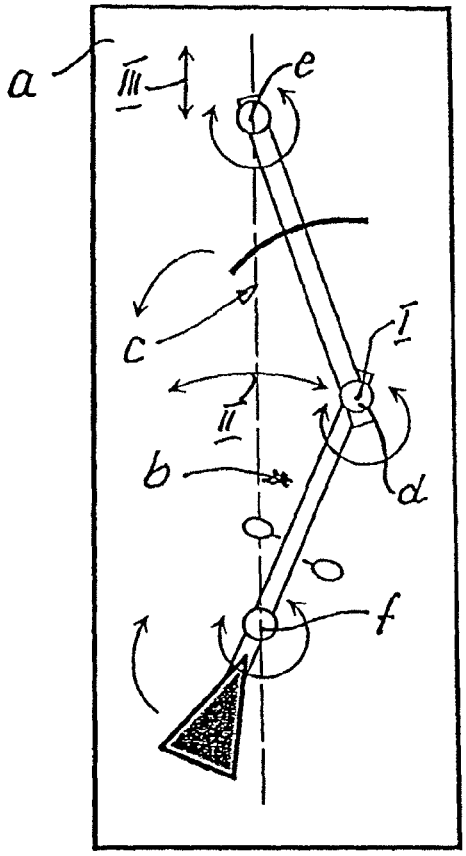
Figure 3:
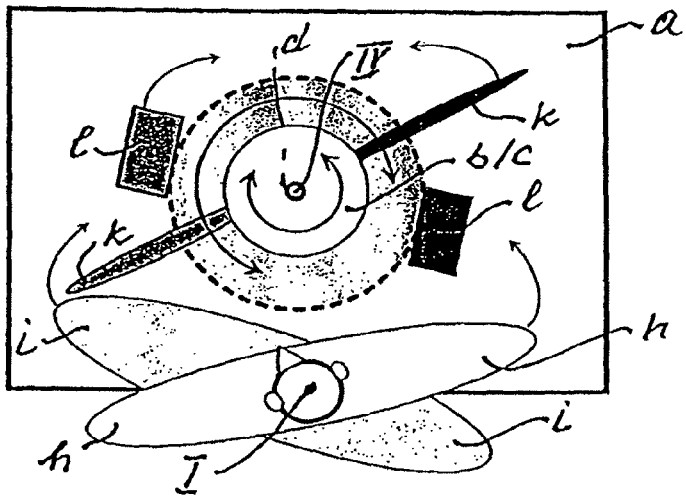

FIGS. 1 to 3 schematically show the functional principle of the invention in a view from above, wherein it is critical that the training device causes a relative twisting movement between shoulder girdle and pelvic girdle for the training person, meaning around the vertebral column axis I between these girdles. In principle, each training device has a pedestal or support a on which the training device is locally secured in place. Secondly, each training device has a device foot part b and a device arm part c which are respectively acted upon by the feet or legs and/or the hands or arms of the training person. A rotating join d with axis of rotation I is disposed between the device foot part b and the device arm part c and connects both sections.

FIGS. 1 and 2 show basic examples where the rotating joint d also functions as knee joint, meaning it is moved back and forth during the training in accordance with double arrow II, so that the device foot part b and the device arm part c execute a buckling movement with continuously changing angle in the region of rotating joint d. As a result, the total distance between a front support joint e of the device arm part c and a rear support joint f of the device foot part b changes continually. At least one of these support joints e and f must therefore be displaceable back and forth, relative to the longitudinal extension of the device.

The front support joint e for the basic embodiment shown in FIG. 1 is locally secured in place, while the rear support joint f is positioned on a slide g which can be moved back and forth in longitudinal direction of support a, as shown with arrow III.

With the operating principle illustrated in FIG. 2, the rear support joint f is locally secured in place while the front support joint e is arranged such that it can be moved according to arrow III. Otherwise, this principle operates as described for FIG. 1.

FIG. 3 illustrates the inventive principle in a view from above, showing the configuration of a training device, wherein the training person is positioned primarily vertically and the axis I as center axis extends between the shoulder girdle h and the pelvic girdle i, shown only in a basic view. During the training, these two girdles are turned relative to each other back and forth around the axis I. From the shoulder girdle h, the arms grip hand grips k and from the pelvic girdle i the feet via the legs push on the pedals 1. With this representation, the rotating joint d coincides with the vertical axis IV which extends parallel to the vertebral column I for this training device. The device foot part b and the device arm part c in this case are disposed one above the other, not shown in FIG. 3, with the rotating joint d disposed in-between, wherein the pedals 1 are arranged on the foot part b and the hand grips k are arranged on the arm part c. FIG. 3 shows that whenever the shoulder girdle h with the hand grips k is turned in one direction, the pelvic girdle with the pedals 1 is turned in the other direction (see also FIG. 14).

Besides the initially described advantage of a varied training for the muscles, as well as the mental training, the movement principle also has a positive effect on the bowel function, particularly through the rhythmic back and forth movement. In principle this relative turning movement between shoulder girdle and pelvic girdle, e.g. caused by the buckling on the device, corresponds to the human movement pattern as it can be observed in humans from the small child to the adult for which the right foot is moved forward along with the left arm and vice versa, which corresponds to this relative turning movement according to the principles of our invention. As a result, the training according to this principle can also have a prophylactic or therapeutic effect, particularly for back problems (curvature of the vertebral column and the like).

Figure 4:
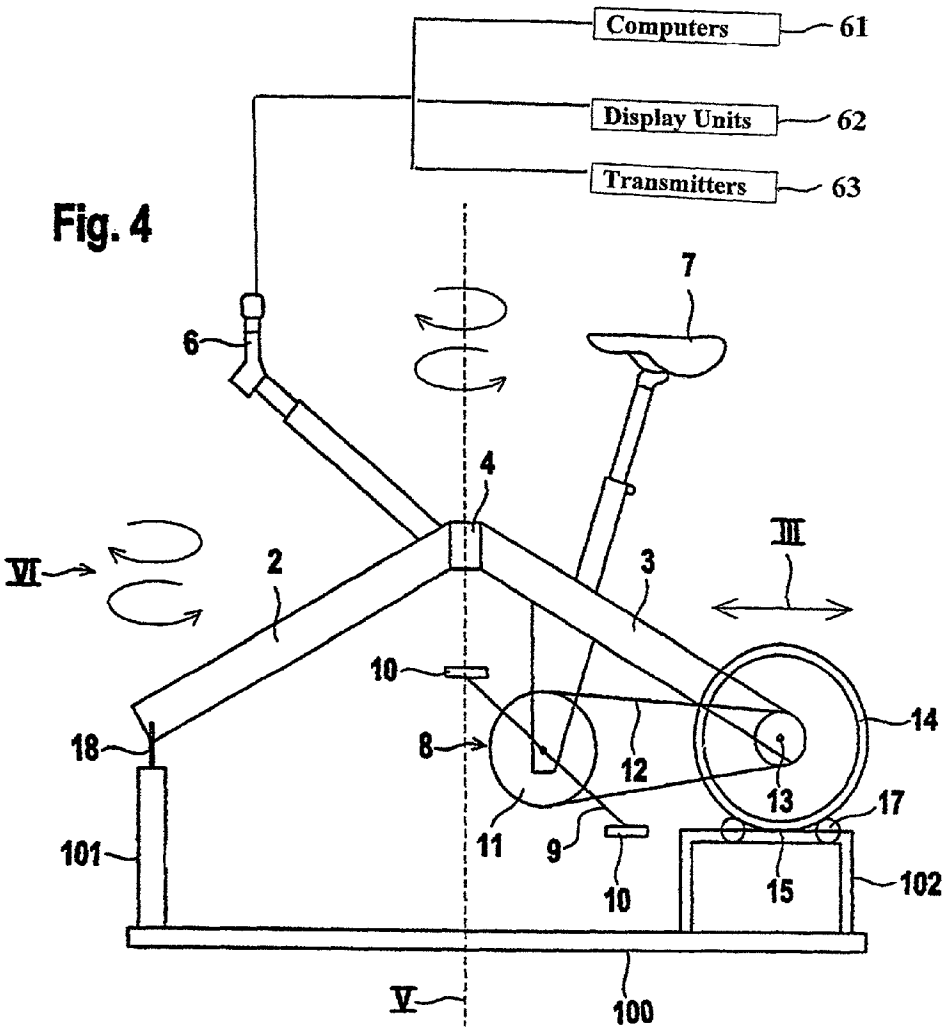
FIGS. 4 to 6 are a first embodiment in a view from the side.

FIG. 4 shows a first embodiment of a fixed training device 1 with a support 100 according to the active functional principle described for FIG. 1 above. A front frame half 2 (device arm part) and a rear frame half 3 (device foot part) are connected to each other via a joint (rotating joint d) with a vertically extending joint axis V. An end of the rear frame half 3 is coupled to a first support end 102 of support 100 and an end of the front frame half 2 is coupled to a second support end 101 of support 100 in order to secure the device 1 locally. The support 100 remains stationary when the rear frame half 3 and the front frame half 2 are moved relative to each other. A handlebar 6 is arranged on the front frame half 2 while a saddle 7 is attached to the rear frame half 3, wherein the rear frame half 3 is also provided with a drive unit 8. This drive unit comprises a bottom bracket bearing, not shown in the drawing, cranks 9, pedals 10, gear rims 11 and a chain 12. A wheel 14 is positioned at the rear frame half via a horizontally extending shaft 13 and is driven to rotate by the drive unit 8. The wheel rolls off a slide 15, which is positioned so as to be displaceable to the side and in longitudinal direction, wherein the arrow III indicates the displacement in longitudinal direction. The slide 15 is provided with two rollers 17 on which the wheel 14 rolls off. The front end of the front frame half 2 is positioned on a pivot 18, such that it can rotate around a vertical axis, wherein the rotation around this axis is shown with arrows VI in the drawing. A deflection of the joint 4 leads to a turning of the front frame half 2 around a vertical axis on the pivot 18. In the process, the distance between the front end of the front frame half 2 and the back end of the rear frame half 3 is shortened, thus leading to a forward displacement of the slide 15, wherein a deflection to the side of the slide 15 can also be provided according to arrow VII in FIG. 1.

Figure 5:
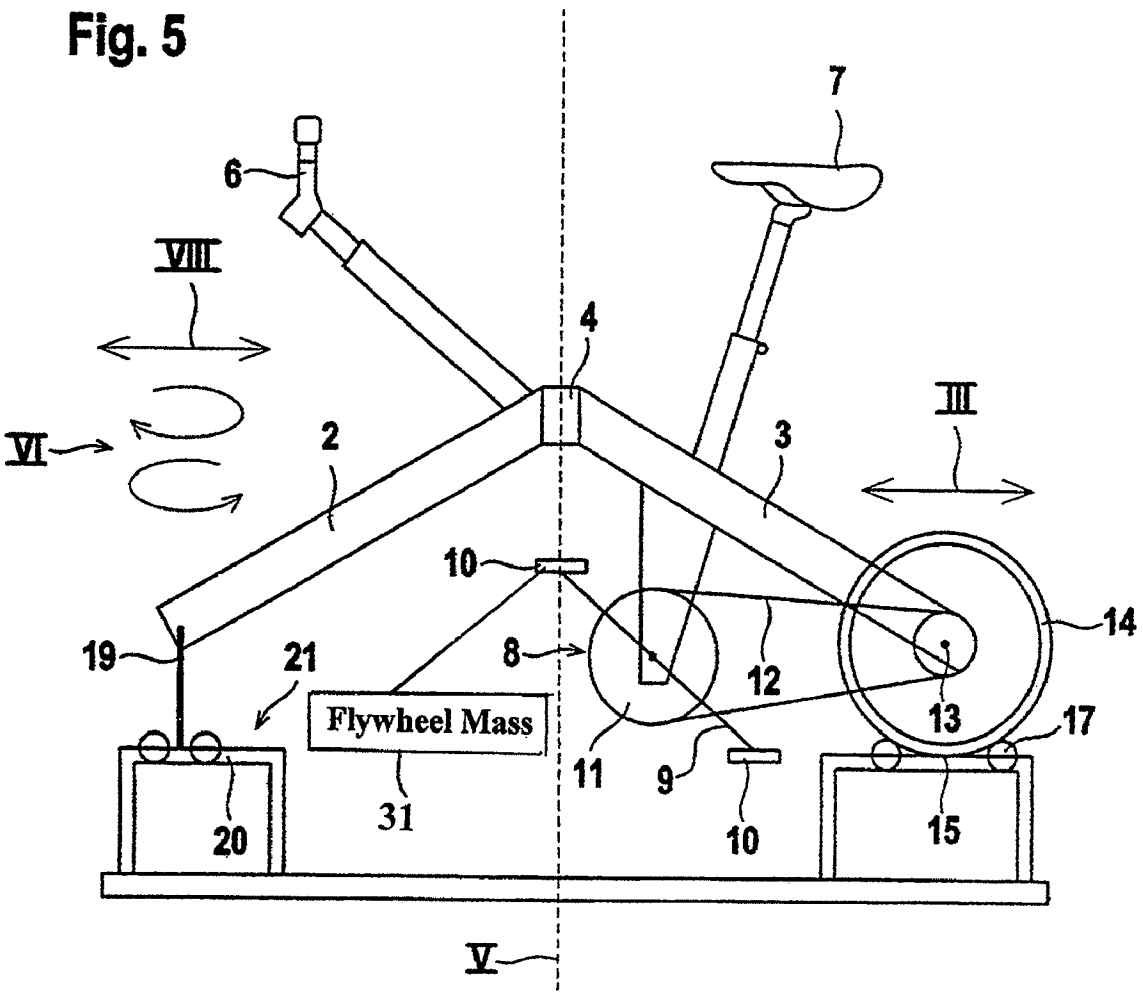

FIG. 5 shows a variant of this first exemplary embodiment, for which the reactive functional principle is realized. The two exemplary embodiments differ only in the positioning of the front frame half 2. All other parts are identical and are therefore given the same reference numbers. The pivot 19 for front frame half 2 is also positioned on a moving slide 20, wherein this slide 20 can be moved back and forth in axial direction as indicated with arrow VIII. Also possible is a rotation around the pivots 21, which is indicated with arrows VI.

Figure 6:
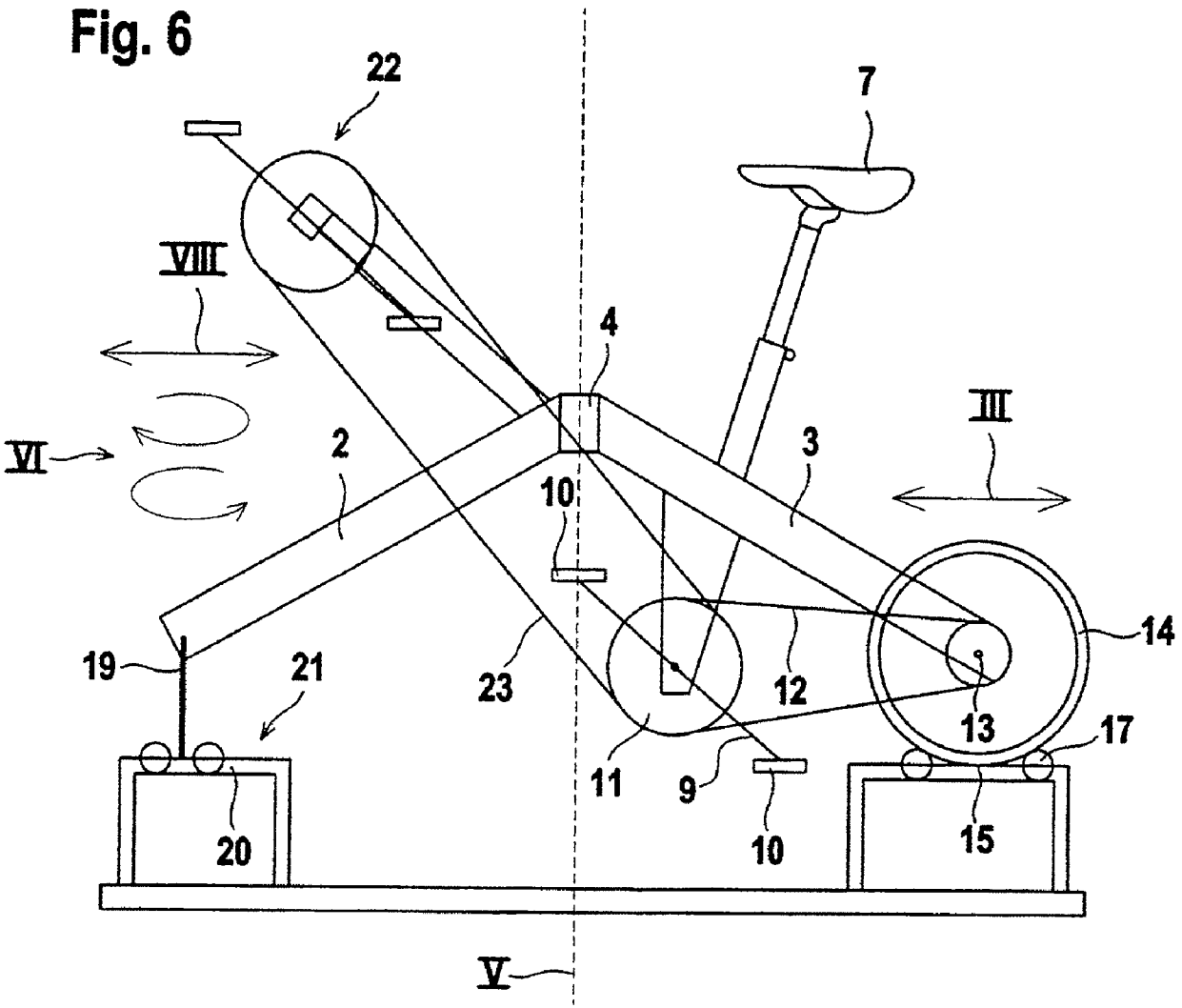

FIG. 6 shows an additional variant of this first embodiment. However, in contrast to the variant shown in FIG. 5, a hand-operated crank system 22 is provided in place of a handlebar, which is connected via a chain or a belt 23 to the foot-operated crank system 9 to 11. Particularly applicable here is the active system, described for FIG. 3, of the fundamental counter-rotation and the physical offset of arm movement and leg movement.

Figure 7:
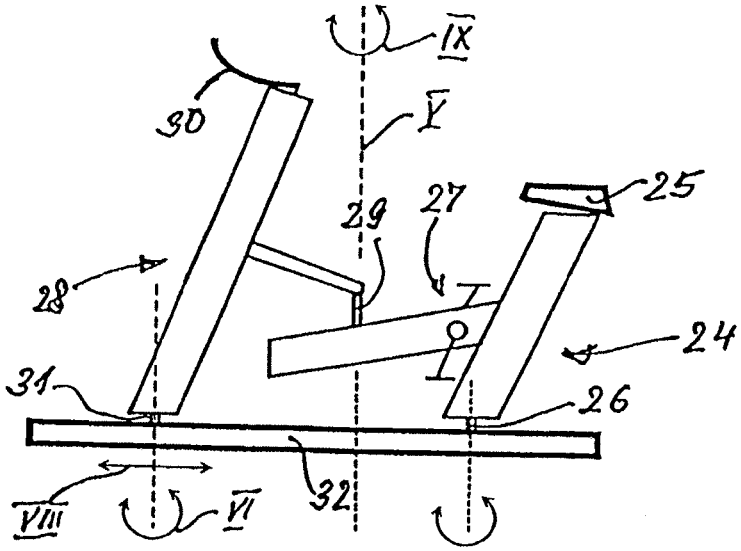
FIG. 7 is a second embodiment in a view from the side.

FIG. 7 shows an embodiment, for which the device foot part 4 is provided with a saddle 25, an axis of rotation 26, and a foot-operated crank system 27, wherein this device foot part 24 is connected to a device arm part 28 via a rotating joint 29, thereby permitting a rotation around the axis V as shown with the double arrow IV. The movement principle in this case is realized in a similar manner as shown in FIG. 2. The device arm part 28 is provided with a handlebar 30 as well as an axis of rotation 31, disposed inside a support plate 32 so as to be displaceable in longitudinal direction of the device. Of course, it can also be positioned in the same way in the lower portion of the device arm part 28. The movement of device arm part 28, made possible in this way, corresponds to the double arrows VI and VIII.

According to the invention, a crank system can replace the handlebar which, as described for FIG. 6, operates so as to be naturally synchronized with the foot-operated crank system. The foot-operated crank system 27 can be provided with braking devices or, for rehabilitation purposes, also with driving devices for the crank system.

Figure 8:
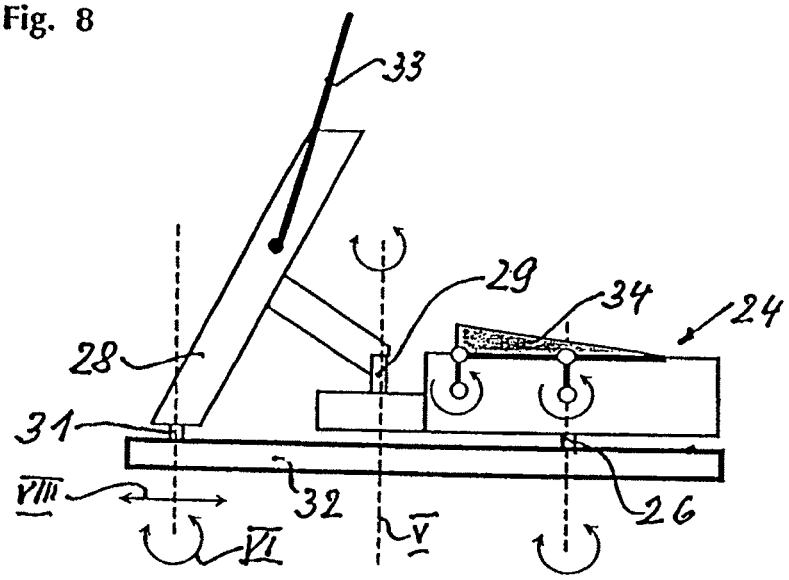
FIGS. 8 and 9 are a third embodiment, respectively shown in a view from the side and a view from above.
Figure 9:
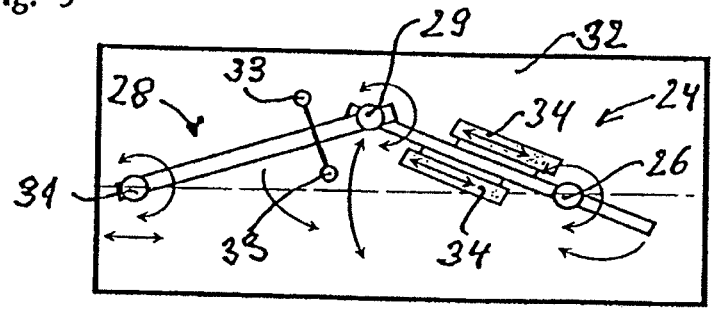

FIG. 8 shows a different type of training device, also referred to as elliptical trainer in a similar configuration. Here too, a device foot part 24 and a device arm part 28 are positioned on a support plate 32 and are connected via a rotating joint 29, wherein the device arm part 28 here can execute the symptomatic movement via its axis of rotation 31 in the support plate 32, as shown with double arrows VIII and VI.

The training person hand grips arm rods 33 which are positioned either rigidly mounted or such that they can alternatively swivel relative to each other. A running device 34 with tread plates that follow an oval course is provided in the device foot part 24, wherein it can also be embodied with a running belt. The principle shown in FIG. 2 is used for this embodiment as well.

Figure 10:
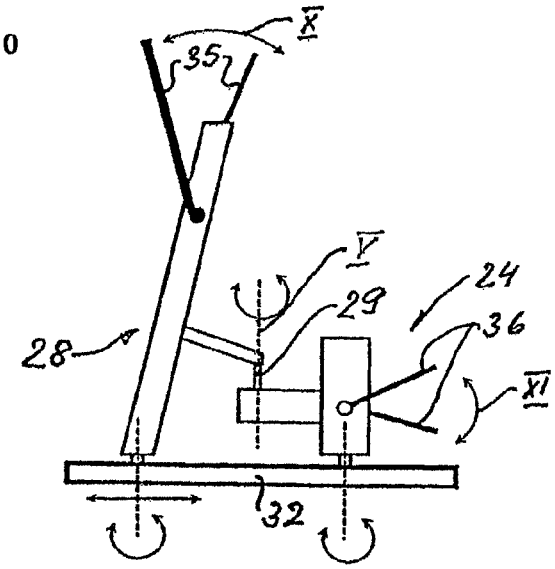
FIG. 10 is a fourth embodiment in a view from the side.

The exemplary embodiment shown in FIG. 10, a so-called stepper, is in principle configured the same way as the exemplary embodiment according to FIG. 7 with respect to the device foot part 24, the device arm part 28, as well as the support plate and rotating joint 29. However, this embodiment differs in that it has arm rods 35, which can be swiveled back and forth by the training person in different turning direction depending on the rod, as shown with double arrow X. The embodiment is further provided with tread plates 36 on the device foot part for which the swivel-tread movement according to double arrow XI is matched to the arm rod 35 movement, such that it corresponds to the natural movement sequence when running or walking.

The therapy according to the invention is achieved as a result of the inventive turning of the rotating joint 29 around the axis of rotation V.

Figure 11:
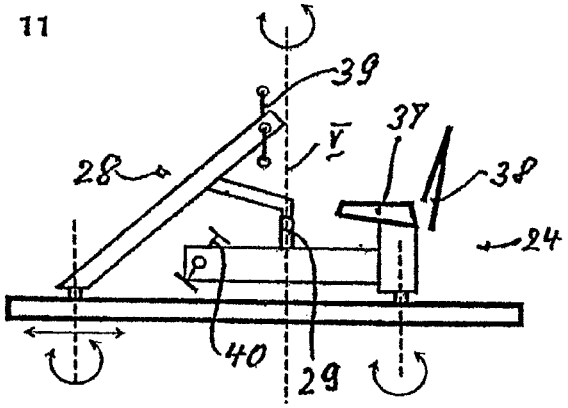
FIG. 11 is a fifth embodiment, showing a special design for the embodiment according to FIG. 7.

Since the training device according to FIG. 11 above all is used for reclining individuals, the seat 37 is provided with a backrest 38 and the device arm part 28 is inclined so as to allow easy access without problems for the possibly handicapped training person or even an older persons. In place of the hand-operated crank 39, shown therein, an arm lever system or a rigid handlebar can also be provided. In place of the foot-operated crank 40, tread plates or rigid supports can be provided. Important is the arrangement of the rotating joint 29 between device foot part and device arm part, wherein the foot-operated crank 40 is arranged below the device arm part 28, meaning to the left of rotating joint 29 in this Figure.

Figure 12:
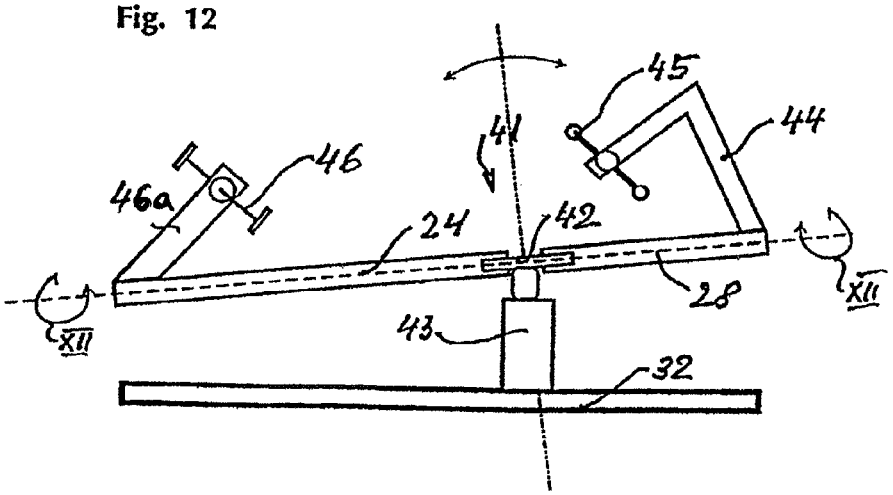
FIGS. 12 and 13 are a sixth embodiment showing a bench trainer.

FIG. 12 shows a two-part training bench 41 and a device foot part 24 that is connected to the device arm part 28 via the rotating joint 42. The two parts can be turned relative to each other in their respective planes via the rotating joint 42 and corresponding to double arrows XII, so that the shoulder girdle of the training person which rests on the part 28 is turned relative to the pelvic girdle which rests on the part 24. The rotating joint 42 is correspondingly positioned on a support pedestal 43 which in turn sits on the support plate 32. For the physical activity, an additional arm 44 with hand-operated crank system 45 is arranged on the device arm part 28 and an arm 46*a* with foot-operated crank system 46 is arranged on the device foot part 24. The slanted position of training bench 41, meaning of the rotating joint 42 relative to the support plate 32, can in principle be adjusted. Other types of operating elements can also be used in place of the hand-operated or foot-operated cranks.

Figure 13:
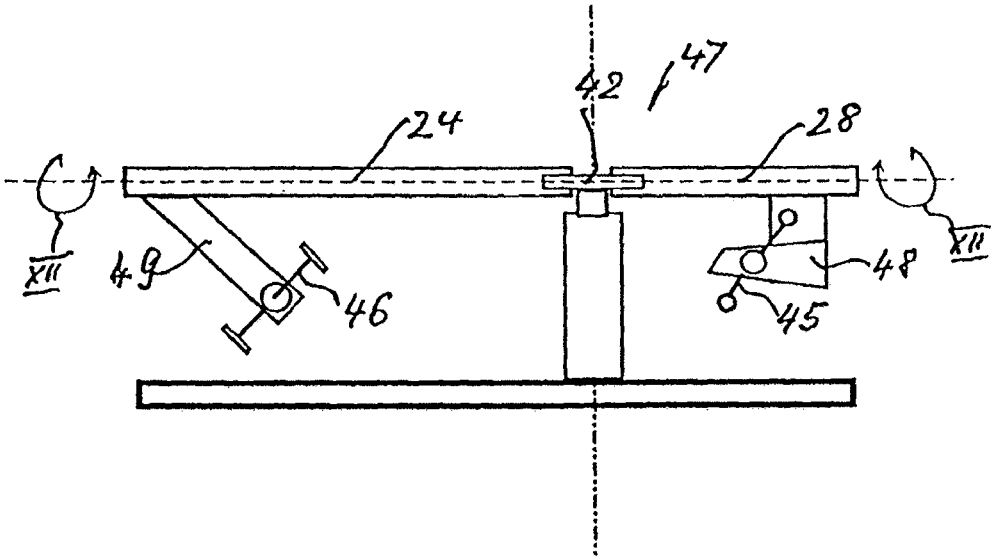

Although the training bench 47 shown in FIG. 13 has a two-part design that is identical to that of the training bench shown in FIG. 12, the training is here carried out while resting on the abdomen, with the operating elements being arranged below the device foot part 24 and the device arm part 28. The bench sections shown herein are also provided with special arms 48 and 49 which are respectively provided with a hand-operated crank 45 and a foot-operated crank 46. For the therapy according to the invention, the two bench sections 24 and 28 of this embodiment can also be turned relative to each other, as shown with the double arrows XII.

Figure 14:
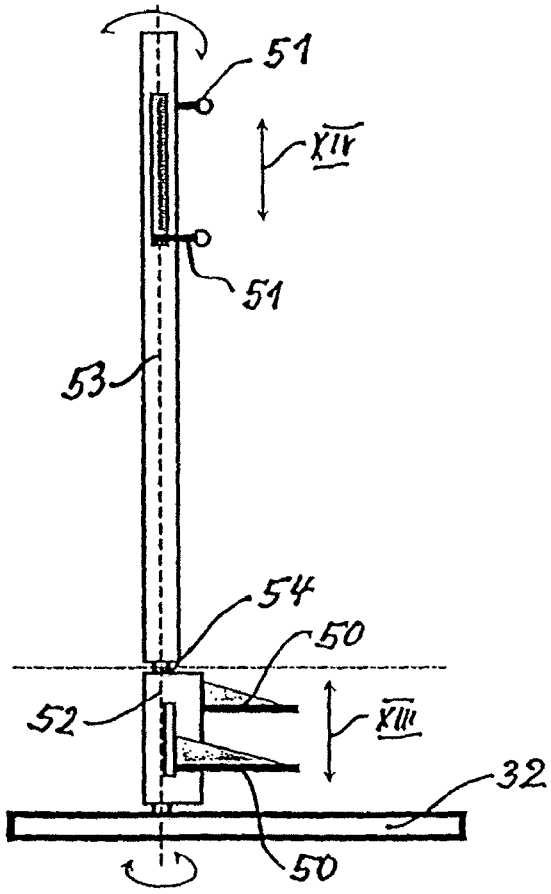
FIG. 14 is a seventh embodiment, designed for the climbing training.

The training device shown in FIG. 14 is a so-called climber where the training person stands upright on tread plates 50, which can be moved up and down as shown with double arrow XIII, and holds onto hand grips 51 which can also move up and down according to double arrow XIV. The rotating joint 54 is arranged between the device foot part on the support plate 32, with thereon mounted tread plates 50, and the device arm part 53 with attached hand grips 51, which is arranged vertically above it. The training principle realized with this equipment is explained in further detail in the description for FIG. 3.

It will be understood that the above description of the present invention is susceptible to various modifications, changes and adaptations, and the same are intended to be comprehended within the meaning and range of equivalents of the appended claims.

What is claimed is:

1. A stationary training device to target train a body of a person lying on the training device, the device comprising:

a stationary support to secure the training device locally;

a device foot part having a first support to support a lower portion of the person's body and action elements coupled to the first support for movement by the legs of the person, the first support having a first length and a first longitudinal axis running along the first length;

a device arm part having a second support to support an upper portion of the person's body and action elements coupled to the second support for movement by the arms of the person, the second support having a second length and a second longitudinal axis running along the second length; and a connecting joint having a third length and a third longitudinal axis running along the third length, the connecting joint being mounted on the stationary support, to couple the device foot part with the device arm part to allow the device foot part and the device arm part to displace relative to each other about a common longitudinal axis that is coaxial with the first, second and third longitudinal axes to permit a relative turning movement in a region of a vertebral column axis, between the pelvic girdle and the shoulder girdle, of the person when lying on the first and second supports.

2. The stationary training device according to claim 1, wherein the relative displacement occurs randomly by random movements of the person when lying on the device.

3. A stationary training device to target train a body of a person lying on the training device, the device comprising:

a stationary support to secure the training device locally;

a training bench having a rotational axis that extends in a longitudinal direction of the training bench, the training bench having a dividing area that laterally divides the training bench into first and second longitudinal sections, wherein:

the first longitudinal section comprises a device foot part including a lower body support with first action elements for movement by the legs of the person, and the second longitudinal section comprises a device arm part including an upper body support with second action elements for movement by the arms of the person, wherein the second action elements comprise cranks, wherein the second action elements are coupled to the device arm part so that the second action elements are displaceable about the rotational axis; and a connecting joint coupled to the stationary support and the training bench at the dividing area to mount the training bench, wherein the rotational axis of the training bench is coaxial with a longitudinal axis of the connecting joint so that the device foot part and the device arm part are displaceable relative to each other about the rotational axis to permit a relative turning movement in a region of a vertebral column axis, between the pelvic girdle and the shoulder girdle, of the person when lying on the first and second longitudinal sections.

4. A stationary training device to target train a body of a person lying on the training device, the device comprising:

a stationary support to secure the training device locally;

a training bench having a rotational axis that extends in a longitudinal direction of the training bench, the training bench having a dividing area that laterally divides the training bench into first and second longitudinal sections, wherein:

the first longitudinal section comprises a device foot part including a lower body support with first action elements for movement by the legs of the person, wherein the first action elements comprise cranks, wherein the first action elements are coupled to the device foot part so that the first action elements are displaceable about the rotational axis, and the second longitudinal section comprises a device arm part including an upper body support with second action elements for movement by the arms of the person; and a connecting joint coupled to the stationary support and the training bench at the dividing area to mount the training bench, wherein the rotational axis of the training bench is coaxial with a longitudinal axis of the connecting joint so that the device foot part and the device arm part are displaceable relative to each other about the rotational axis to permit a relative turning movement in a region of a vertebral column axis, between the pelvic girdle and the shoulder girdle, of the person when lying on the first and second longitudinal sections.

5. A stationary training device to target train a body of a person lying on the training device, the device comprising:

a stationary support to secure the training device locally;

a training bench having a rotational axis that extends in a longitudinal direction of the training bench, the training bench having a dividing area that laterally divides the training bench into first and second longitudinal sections, wherein:

the first longitudinal section comprises a device foot part including a lower body support with first action elements for rotational movement by the legs of the person, and the second longitudinal section comprises a device arm part including an upper body support with second action elements for movement by the arms of the person, wherein the second action elements comprise cranks that are coupled to the device arm part and rotatable about the rotational axis; and a connecting joint coupled to the stationary support and the training bench at the dividing area to mount the training bench, wherein the rotational axis of the training bench is coaxial with a longitudinal axis of the connecting joint so that the device foot part and the device arm part are displaceable relative to each other about the rotational axis to permit a relative turning movement in a region of a vertebral column axis, between the pelvic girdle and the shoulder girdle, of the person when lying on the first and second longitudinal sections.

* * * * *